US006071185A

United States Patent [19]

Genau et al.

[11] Patent Number: 6,071,185

[45] Date of Patent: Jun. 6, 2000

[54] ABRASIVE WHEEL

[75] Inventors: Claus Genau, Köln; Bernd Stuckenholz, Wiehl; Theodor Schneider, Solingen, all of Germany

[73] Assignee: August Rüggeberg GmbH & Co., Marienheide, Germany

[21] Appl. No.: 09/163,474

[22] Filed: Sep. 30, 1998

[30] Foreign Application Priority Data

Oct. 16, 1997 [DE] Germany ..... 197 45 709
Jun. 25, 1998 [DE] Germany ..... 198 28 357

[51] Int. Cl.[7] ..... B24D 3/28

[52] U.S. Cl. ..... 451/541; 451/548

[58] Field of Search ..... 451/449, 541, 451/548

[56] References Cited

U.S. PATENT DOCUMENTS 2,624,660 1/1953 Teague ..... 451/541 X
2,997,820 8/1961 Skoog ..... 451/548
3,609,925 10/1971 Comella-Riera ..... 451/449 X
3,867,795 2/1975 Howard ..... 451/548
5,092,082 3/1992 Padberg et al. ..... 451/548
5,431,596 7/1995 Akita et al. ..... 451/548 X
5,584,755 12/1996 Alfer et al. .

FOREIGN PATENT DOCUMENTS 528370 9/1957 Italy ..... 451/541

*Primary Examiner*—David A. Scherbel
*Assistant Examiner*—Anthony Ojini
*Attorney, Agent, or Firm*—Browdy and Neimark

[57] ABSTRACT

An abrasive wheel having an annular support disk and an abrasive ring fixed thereto comprises reinforcement layers on the front sides of the abrasive ring, a layer of an abrasive agent being disposed between the reinforcement layers. The reinforcement layers and the outer portion of the support disk overlap each other radially, at least one reinforcement layer, in this area, being connected with an annular flange of radial extension by means of an adhesive layer.

13 Claims, 3 Drawing Sheets

ABRASIVE WHEEL

BACKGROUND OF THE INVENTION

1. Field of the Invention

The invention relates to an abrasive wheel.

2. Background Art

U.S. Pat. No. 5,584,755 teaches an abrasive wheel, in particular an abrasive cutting-off wheel, which has an inner support disk of metal in the shape of a circular ring and an abrasive ring encircling the latter, both being connected with each other. The support disk has an annular cylindrical outer rim which projects in the direction of the central longitudinal axis of the abrasive wheel and to which the abrasive ring is fixed by means of an adhesive layer. The two front sides of the abrasive ring possess reinforcement layers of reinforcing threads, the extension of which is tangential in the vicinity of the central opening of the abrasive ring and radial tangential in the shape of an approximate partial spiral towards the outer circumference. These reinforcing threads run from the central opening in accordance with the direction of main stress. Consequently, the reinforcing threads extend substantially in accordance with the actual strain on the rotating abrasive ring. The maximum main stress of a rotating abrasive ring runs in the tangential direction. The tangential stress, i.e. the course of tangential stress, has its maximum in the vicinity of the central opening, this maximum decreasing continuously outwards. With this design, the adhesive layer in the vicinity of the annular cylindrical rim of the support disk only has to transmit purely tangential forces from the support disk to the abrasive ring. This known design of an abrasive ring has the drawback that the described reinforcement layers are rather complicated.

SUMMARY OF THE INVENTION

It is an object of the invention to embody an abrasive ring which can be equipped with reinforcement layers of little constructional requirements, but will still bear high strains.

According to the invention, this object is attained in an abrasive wheel comprising an annular support disk having a central longitudinal axis; an abrasive ring fixed to the support disk coaxially to the central longitudinal axis and which is provided with reinforcement layers on its front sides and which, between the reinforcement layers, comprises a layer of an abrasive agent connected therewith; and at least one annular flange formed on the support disk in a radially outer portion thereof related to the central longitudinal axis and having an outer surface which extends radially to the central longitudinal axis and to which a reinforcement layer is fixed by means of an adhesive layer, radially overlapping the outer surface. The gist of the invention resides in that the reinforcement layers are disposed to overlap the support disk radially and that at least one reinforcement layer is fixed to the support disk by gluing in the overlapping portion. This results in an abrasive wheel construction in which the gluing between the at least one reinforcement layer and the support disk can transmit maximum forces. Only shearing strains occur in the adhesive layer, whereas the threads in the reinforcement layer only take up tensile forces. This enables reinforcement layers to be employed which consist of normal warp and weft thread fabrics, in particular of glass cloths.

Further features, advantages and details of the invention win become apparent from the ensuing description of exemplary embodiments, taken in conjunction with the drawing.

DESCRIPTION OF THE PREFERRED EMBODIMENTS

Figure 1:
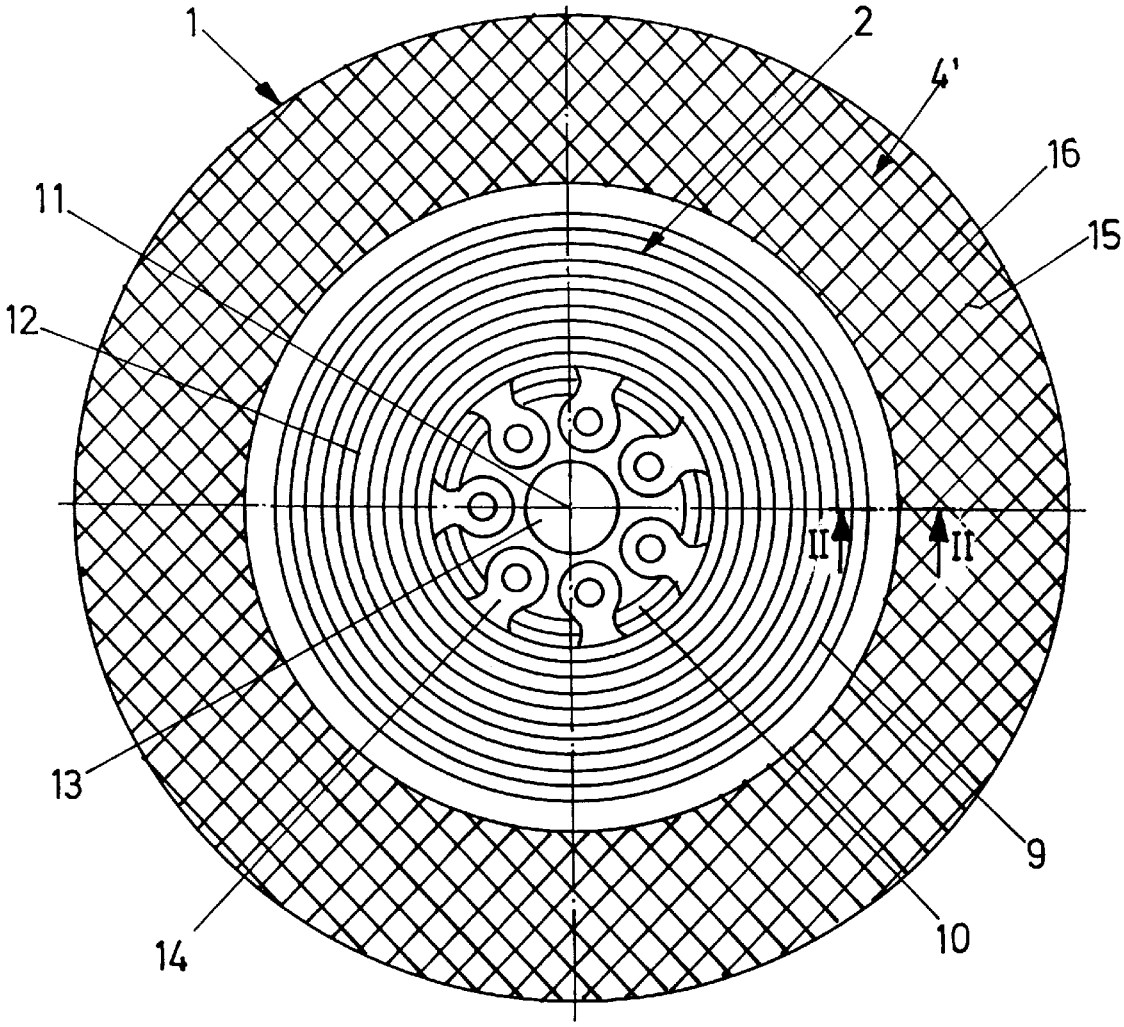
FIG. 1 is a plan view of an abrasive wheel.
Figure 2:
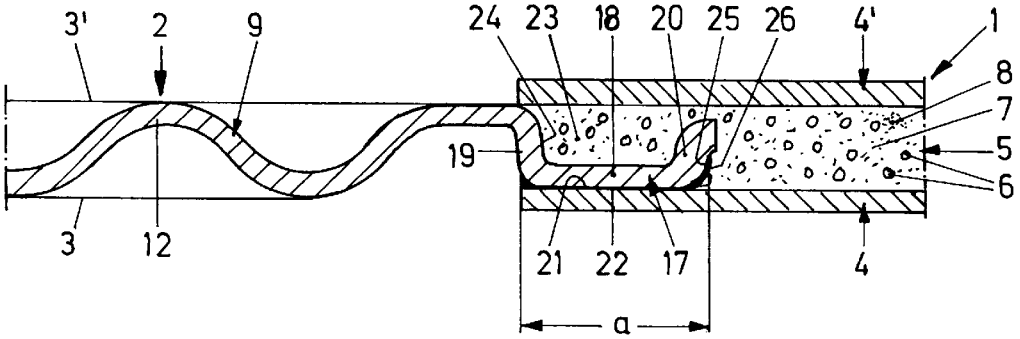
FIG. 2 is a partial cross-section through the abrasive wheel on the section line II—II of FIG. 1.

FIGS. 1 and 2 illustrate an abrasive wheel which is an abrasive cutting-off wheel, in particular a hand-operated abrasive cutting-off wheel, i.e. an abrasive cutting-off wheel to be used in hand-operated grinding machines. It comprises an abrasive ring 1 and a support disk 2.

In the vicinity of each of its front sides 3, 3', the abrasive ring I comprises a reinforcement layer 4, 4'. A layer of an abrasive agent 5 consisting of abrasive grain 6, binding agents 7 and fillers 8 is disposed between the reinforcement layers 4, 4'. Aluminum oxide, silicon carbide, zirconium corundum, sol-gel grain and mixes thereof are preferred as abrasive grain 6. Pure or modified synthetic resins serve as a binding agent 7. Pyrite, cryolite and potassium cryolite are utilized as fillers 8. The abrasive grain 6 has a nominal grain size in the range of 315 to 1000 $\mu$m.

The support disk 2 consists of comparatively thin sheet steel, possibly of stainless steel, aluminum or brass.

The support disk 2 comprises an annular outer portion 9 and an inner hub portion 10 which, in the same way as the abrasive ring 1, are disposed concentrically of the central longitudinal axis 11 of the abrasive wheel. The outer portion 9 of the support disk 2 is configured so as to attain the desired rigidity. In the exemplary embodiment shown, it is provided with one or several grooves (crimps) disposed concentrically of the axis 11 and serving as reinforcing ribs 12 and in cross-section having approximately the shape of sinusoidal waves, as can be seen in the cross-sectional illustrations.

The hub portion 10 of the support disk 2 possesses a hub opening 13 formed concentrically of the axis 11. It may further be equipped with reinforcing strips 14, for instance of a keyhole-type configuration in the plan view. Further, the hub portion 10 can be forced out of the plane of the outer portion 9 in the direction of the axis 11 or it may lie in this plane.

As can further be seen in FIG. 1, the reinforcement layers 4, 4' consist of a fabric, namely a glass cloth, which is formed of warp threads 15 and weft threads 16 running at right angles to each other.

As seen in the cross-sectional view according to FIG. 2, the outer portion 9 of the support disk 2, where passing into the abrasive ring 1, has an outer annular groove section 17 which comprises an annular flange 17 of an extension radial to the axis 11, a connecting leg 19 of an extension annular cylindrical to the axis 11 and joining the annular flange 18 to the neighboring reinforcing rib 12, and a radially outer free leg 20 equally of an extension approximately annular cylindrical to the axis 11. A reinforcement layer 4 is fixed to the outer surface 21 of the groove section 17 by means of an adhesive layer 22, the outer surface 21 in the shape of a circular ring extending radially to the axis 11. This reinforcement layer 4 radially overlaps the support disk 2 by a range that corresponds approximately to the radial extension a of the annular flange 18.

The interior space 23 of the groove section 17 is also filled with the abrasive agent 5 consisting of abrasive grain 6, binding agent 7 and fillers 8; in this case the reinforcement layer 4' and the abrasive agent 5 are glued together equally by means of the binding agent 7, the abrasive agent 5 in turn being glued on the inner surface of the groove section 17 equally by means of the binding agent 7. By alternative, the interior space 23 of the groove section 17 may also be filled with an adhesive by means of which to implement the fastening of the reinforcement layer 4' to the support disk 2.

The radially outer surface 25 of the free leg 20 of the groove section 17 is likewise provided with an adhesive layer 26 to which adheres the abrasive agent 5. Also the reinforcement layer 4' overlaps the support disk 2. As seen in FIG. 2, the two reinforcement layers 4, 4 have an identical inside diameter, i.e. the reinforcement layers 4, 4' are of identical configuration.

Figure 3:
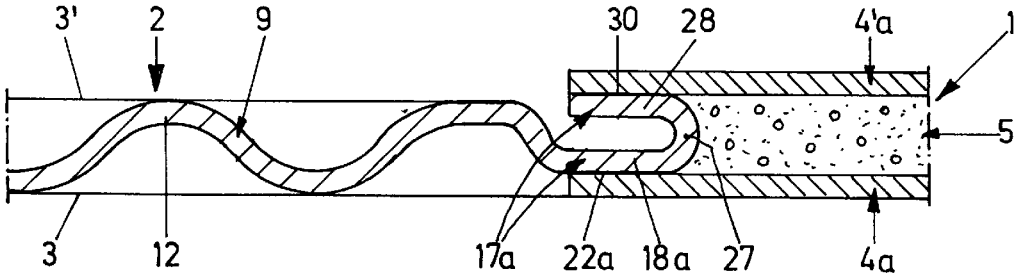
FIG. 3 is a cross-section through a modified embodiment of an abrasive wheel in an illustration corresponding to FIG. 2.

In the embodiment according to FIG. 3, a groove section 17*a*, which is U-shaped in cross-section, is formed on the exterior edge of the support disk 2. An annular flange 18*a*, which extends radially to the axis 11, is followed via a web 27 by a second annular flange 28 which extends parallel to the annular flange 18*a*. On their outer surfaces 21*a* and 29, both annular flanges 18*a* and 28 are provided with adhesive layers 22*a* and 30, respectively, to which the inner portion of the reinforcement layers 4*a*, 4'*a* is fixed.

Figure 4:
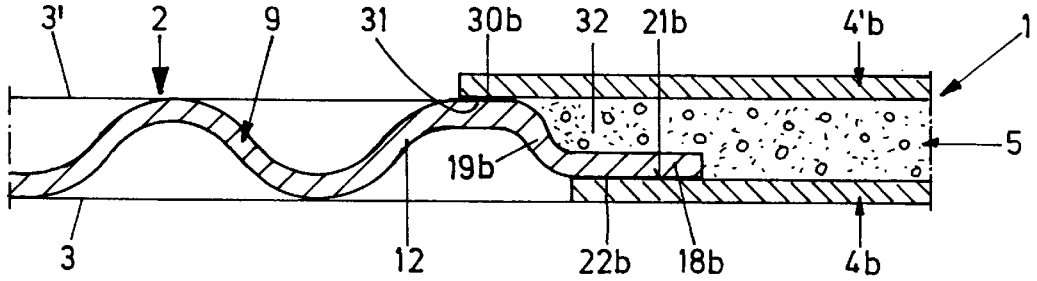
FIG. 4 is an illustration, corresponding to FIG. 2, of another embodiment of an abrasive wheel.

In the embodiment according to FIG. 4, an annular flange 18*b* is formed on the outer rim of the support disk 2, the annular flange 18*b* extending radially to the axis 11 and the reinforcement layer 4*b* being fixed to its outer surface 21*b*. The reinforcement layer 4*b* extends as far as to the outer surface 31 of the nearest neighboring reinforcing rib 12, where it is fixed by means of an adhesive layer 30*b*. The space 32 between the annular flange 18*b*, the leg 19*b*, connecting the annular flange 18*b* with the neighboring reinforcing rib 12, and the reinforcement layer 4'*b* is equally filled with the abrasive agent 5.

Figure 5:
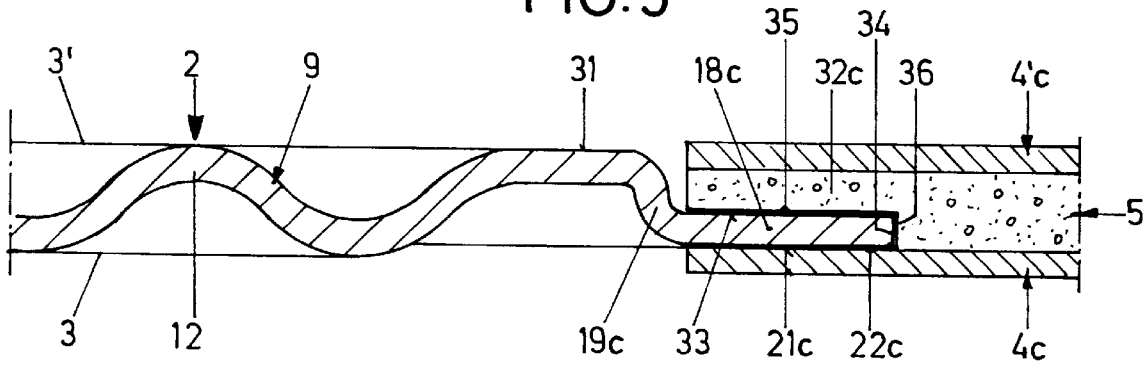
FIG. 5 is an illustration, corresponding to FIG. 2, of another embodiment of an abrasive wheel.

In the embodiment according to FIG. 5, an annular flange 18*c* is formed on the outer rim of the support disk 2 similarly to the embodiment according to FIG. 4, the annular flange 18*c* extending radially to the axis 11 and the reinforcement layer 4*c* being fixed to its outer surface 21*c* by means of an adhesive layer 22*c*. As seen in FIG. 5, the annular flange 18*c* is misaligned by some tenths of a millimeter towards the inside of the support disk 2 as compared to the plane formed by front side 3. This measure serves to prevent the reinforcement layers 4, 4*a*, 4*b*, 4*c* (the thickness of which is exaggerated for all the embodiments in the illustrations of the drawing) from being crushed or squeezed when the abrasive wheel is pressed. The connecting leg 19*c* is similar to the connecting leg 19 in the embodiment of FIG. 2, i.e. it runs approximately cylindrically to the axis 11. The reinforcement layer 4'*c* has the same inside diameter as the reinforcement layer 4*c*, i.e. it does not extend as far as to the outer surface 31 of the nearest neighboring reinforcing rib 12, which deviates from the configuration according to FIG. 4. The space 32*c* between the annular flange 18*c* and the reinforcement layers 4*c* and 4'*c* is equally filled with an abrasive agent 5. The abrasive agent 5 is not in touch with the connecting leg 19*c*.

The annular inner surface 33 turned towards the reinforcement layer 4'*c* and the front 34, in the shape of a cylindrical ring, of the annular flange 18*c* are equally covered with an adhesive layer 35 and 36 by means of which a tight connection is produced between the abrasive agent 5 and the annular flange 18*c*. Since the front 34 in the form of a cylindrical ring is regularly diminutive, the sheet that constitutes the support disk 2 as a rule having a thickness of less than 1.0 mm, the adhesive layer 36 is of no substantial importance; it can just as well be omitted.

What is claimed is:

1. An abrasive wheel, comprising an annular support disk (2) having
- a central longitudinal axis (11),
- an inner hub portion (10) and
- at least one annular flange (18; 18*a*; 18*b*; 18*c*,
  - which is formed on the support disk (2) in a radially outer portion thereof related to the central longitudinal axis (11), and
  - which has an outer surface (21; 21*a*; 21*b*; 21*c*) which extends radially to the central longitudinal axis (11); and an abrasive ring (1),
- which has front sides (3, 3'), and
- which is fixed to the support disk (2) coaxially to the central longitudinal axis (11), and
- which is provided with reinforcement layers (4, 4'; 4*a*, 4'*a*; 4*b*, 4'*b*; 4*c*, 4'*c*) on its front sides (3, 3'), the reinforcement layers turned towards each other with inner sides
- which, between the reinforcement layers (4, 4'; 4*a*, 4'*a*; 4*b*, 4'*b*; 4*c*, 4'*c*), comprises a layer of an abrasive agent (5) connected with the inner sides of the reinforcement layers (4, 4'; 4*a*, 4'*a*; 4*b*, 4'*b*; 4*c*, 4'*c*) and
- which radially extends over said annular flange; wherein the inner side of one of said reinforcement layers (4; 4*a*; 4*b*; 4*c*) is fixed to said outer surface of said annular flange by means of an adhesive layer (22, 22*a*; 22*b*; 22*c*), said one reinforcement layer radially overlapping said outer surface (21; 21*a*; 21*b*; 21*c*) and wherein said inner hub portion is free from said reinforcement layers and said layer of an abrasive agent.

2. An abrasive wheel according to claim 1, wherein the reinforcement layers (4, 4'; 4*a*, 4'*a*; 4*b*, 4'*b*; 4*c*, 4'*c*) are formed of a fabric.

3. An abrasive wheel according to claim 2, wherein the reinforcement layers (4, 4'; 4*a*, 4'*a*; 4*b*, 4'*b*; 4*c*, 4'*c*) are formed of glass cloth.

4. An abrasive wheel according to claim 1, wherein the support disk (2) is provided with two annular flanges (18*a*, 28), to each of which a reinforcement layer (4*a*, 4'*a*) is fixed by means of an adhesive layer (22*a*, 30).

5. An abrasive wheel according to claim 1, wherein the at least one annular flange (18; 18*b*; 18*c*) and the reinforcement layer (4'; 4'*b*; 4'*c*), which is not fixed to said at least one annular flange (18; 18*b*; 18*c*), define a space (23; 32; 32*c*) filled with an abrasive agent (5).

6. An abrasive wheel according to claim 1, wherein a free leg (20) is formed on the at least one annular flange (18), extending at least partially in the direction towards the reinforcement layer (4') which is not fixed to the at least one annular flange (18).

7. An abrasive wheel according to claim 6, wherein a radially outer surface (25), related to the central longitudinal axis (11), of the free leg (20) is provided with an adhesive layer (26), by means of which the abrasive agent (5) is connected with the support disk (2).

8. An abrasive wheel according to claim 1, wherein the at least one annular flange (18; 18*a;* 18*b;* 18*c*) is provided with a connecting leg (19; 19*a;* 19*b;* 19*c*), which extends at least partially in the direction of the central longitudinal axis (11) and which is connected with the support disk (2).

9. An abrasive wheel according to claim 1, wherein the support disk (2) is provided with reinforcing ribs (12).

10. An abrasive wheel according to claim 1, wherein the annular flange (18*c*) is misaligned by some tenths of a millimeter backwards as compared to a plane defined by a front side (3).

11. An abrasive wheel according to claim 1, wherein the annular flange (18; 18*c*) is provided with an adhesive layer (26; 35, 36) on at least one surface (25; 33, 34) turned towards the abrasive agent (5).

12. An abrasive wheel, comprising an annular support disk (2) having a central longitudinal axis (11);

an abrasive ring (1), which has front sides (3, 31), and which is fixed to the support disk (2) coaxially to the central longitudinal axis (11), and which is provided with reinforcement layers (4, 4'; 4*a,* 4'*a;* 4*b,* 4'*b;* 4*c,* 4'*c*) on its front sides (3, 3'), and which, between the reinforcement layers (4, 4'; 4*a,* 4'*a;* 4*b,* 4'*b;* 4*c,* 4'*c*), comprises a layer of an abrasive agent (5) connected with the reinforcement layers (4, 4'; 4*a,* 4'*a;* 4*b,* 4'*b;* 4*c* 4'*c*); and at least one annular flange (18; 18*a;* 18*b;* 18*c*), which is formed on the support disk (2) in a radially outer portion thereof related to the central longitudinal axis (11), and which has an outer surface (21; 21*a;* 21*b;* 21*c*) which extends radially to the central longitudinal axis (11) and to which one of said reinforcement layers (4; 4*a;* 4*b;* 4*c*) is fixed by means of an adhesive layer (22, 22*a;* 22*b;* 22*c*), radially overlapping said outer surface (21; 21*a;* 21*b;* 21*c*), wherein the at least one annular flange (18; 18*b;* 18*c*) and the reinforcement layer (4'; 4'*b;* 4'*c*), which is not fixed to said at least one annular flange (18; 18*b;* 18*c*), define a space (23, 32; 32*c*) filled with an abrasive agent (5).

13. An abrasive wheel according to claim 12 wherein a free leg (20) is formed on the at least one annular flange (18), extending at least partially in the direction towards the reinforcement layer (4') which is not fixed to the at least one annular flange (18).

* * * * *